US005420600A

United States Patent [19]

Strobel et al.

[11] Patent Number: 5,420,600

[45] Date of Patent: May 30, 1995

[54] IC AS A TIMED DRIVE OF A DISPLAY MATRIX

[75] Inventors: Karl-Heinz Strobel, Neutraubling; Max Götz, Abensberg/Offenstetten; Robert Förster, Wörth/Donau, all of Germany

[73] Assignee: Siemens Aktiengesellschaft, Munich, Germany

[21] Appl. No.: 133,801

[22] Filed: Oct. 7, 1993

Related U.S. Application Data

[63] Continuation of Ser. No. 838,204, Feb. 28, 1992, abandoned.

[30] Foreign Application Priority Data

Aug. 31, 1989 [EP] European Pat. Off. ..... 89116142

[51] Int. Cl.[6] ..... G09G 3/36

[52] U.S. Cl. ..... 345/51; 345/34

[58] Field of Search ..... 340/745, 752, 756, 762, 340/784, 792, 793, 800, 801, 811, 814, 765; 345/33, 34, 42, 44–46, 51

[56] References Cited

U.S. PATENT DOCUMENTS

| | | | |
|---|---|---|---|
| 3,636,553 | 1/1972 | Hancock | 340/792 X |
| 4,424,513 | 1/1984 | Hatao et al. | 340/802 X |
| 4,500,880 | 2/1985 | Gomersall et al. | 340/802 X |
| 4,692,760 | 9/1987 | Unno et al. | 340/752 X |
| 4,901,155 | 2/1990 | Hara et al. | 340/752 X |
| 5,021,775 | 6/1991 | Babin | 340/756 X |

FOREIGN PATENT DOCUMENTS

| | | | |
|---|---|---|---|
| 0221698 | 5/1987 | European Pat. Off. | 340/814 |
| 8701848 | 3/1987 | WIPO | 340/792 |

OTHER PUBLICATIONS

Hitachi, MOS LSI Data Book, LCD Driver LSI, Jun. 1987, pp. 43–50.

Hitachi, MOS LSI Data Book, LCD Driver LSI, Jun. 1987 (Data Book 6–24B), pp. 101–150.

NEC Electronics (Europe), product description μPD7225, μPD7227, mPD7228, μPD7229, Mar. 1985, pp. 109–189.

"Ansichtssache", 1989, pp. 20–25 by Duwald & Latzke.

"LCD driver/controller ICs offer versatility in configuration & function", by Ed Teja, EDN Electrical Design News, vol. 30, No. 18 Aug. 8, 1985, pp. 83, 85, 86, 88.

"New Applications for Waveform Identity Addressing of LCDs", by Clark et al Proceedings of the Society for Information Display, vol. 26, No. 2 (1985) pp. 148–155.

"Universele aanstuurschakeling voor LCD's", Elonco Bulletin, No. 121, Mar. 1985, p. 11.

*Primary Examiner*—Jeffery Brier

*Attorney, Agent, or Firm*—Hill, Steadman & Simpson

[57] ABSTRACT

An IC for use in an IC apparatus for providing a timed drive of a display matrix, the display matrix displaying a multi-place text composed of at least one of letters, figures and other characters, and the display matrix having more columns than lines in order to display at least 1-line text. A plurality of identically structured ICs form a chain of such ICs that supply column signals for controlling the columns of the display matrix. Each IC has at least a shift register, a character generator and or read-only memory. The shift register into which bits are shifted which correspond to at least a section of text to be displayed on the display matrix has an input and an output operatively connected to an input pin and an output pin, respectively, of the IC. The character generator is connected downstream of the shift register, the character generator having a separate memory unit, and during operation, the character generator converting into output signals at least some of the bits, which correspond to only a short code for the contents of relevant characters by means of the memory unit which is addressed by these bits. The read-only memory stores bits which are required for different displays and which are to be loaded into shift registers of further ICs and which transmits the relevant bits to the shift register of this IC when a relevant address or start address is called up. During operation only the read-only memory of the first IC of the chain, that transmits to the shift register of this first IC, also transmits bits to a shift register of a next, further IC, and during operation the shift registers of the further ICs of the chain are loaded by a respective shift register of a respective preceding IC of the chain.

14 Claims, 5 Drawing Sheets

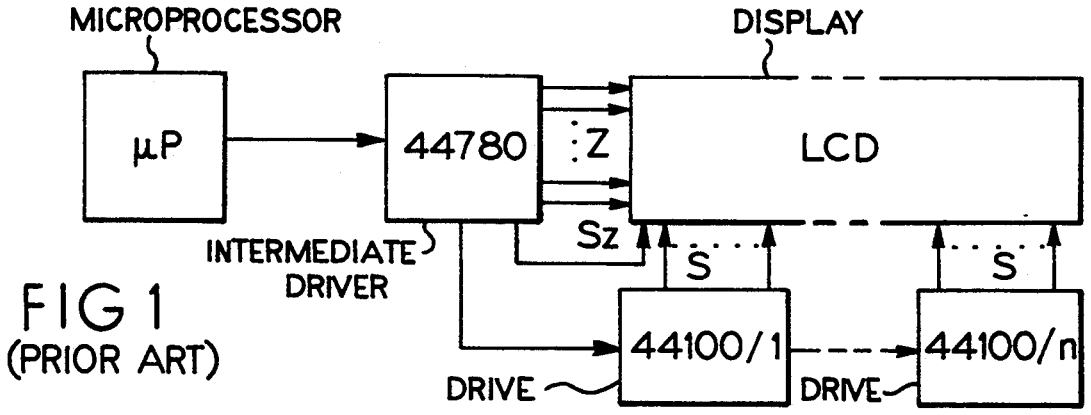
FIG 1
(PRIOR ART)
FIG 2
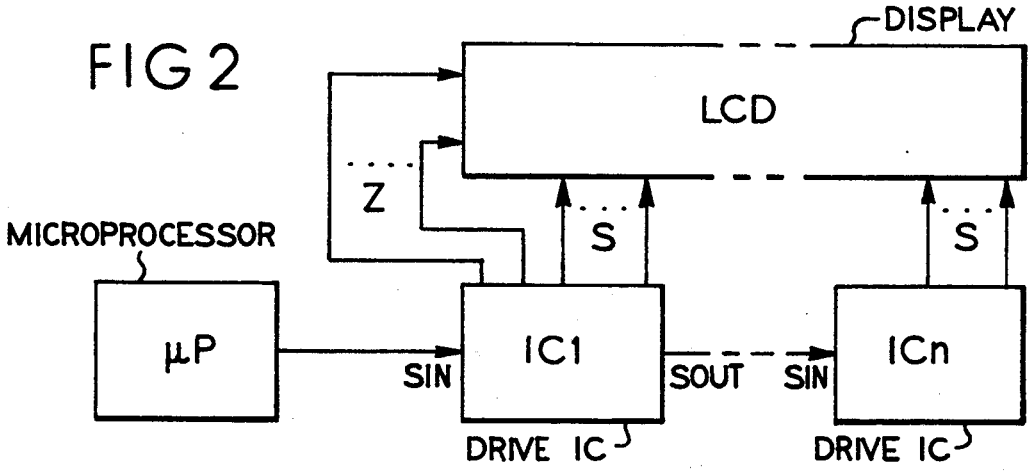
FIG 6
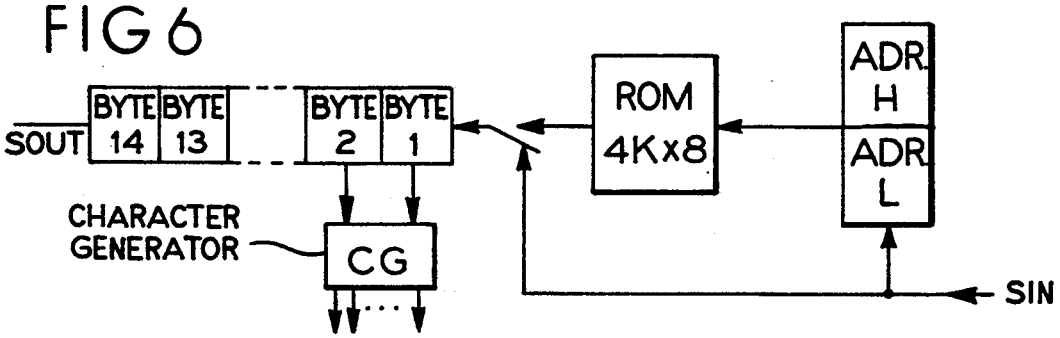
FIG 7
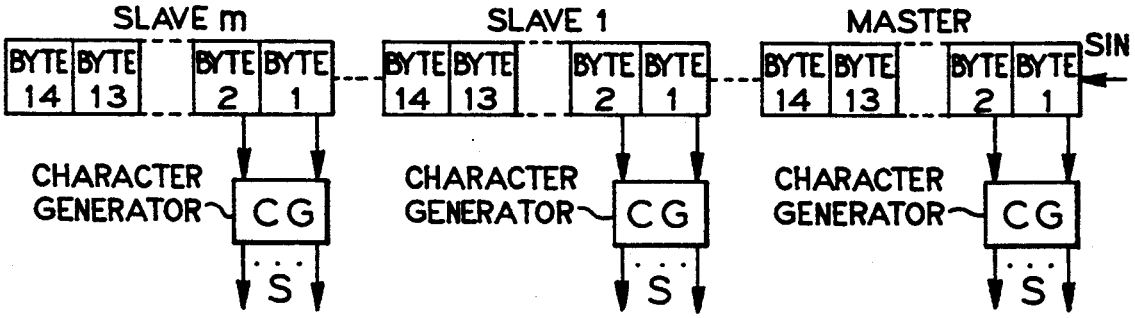

IC AS A TIMED DRIVE OF A DISPLAY MATRIX

This is a continuation of application Ser. No. 838,204, filed Feb. 28, 1992, now abandoned.

BACKGROUND OF THE INVENTION

The invention relates to a special integrated module, namely an improvement of the IC defined in an IC for timed drive of a display matrix. The previously known module has the designation HD44100 and is supplied by Hitachi, this known IC serving primarily as a drive of an LCD display.

FIG. 1 serves to explain this prior art. A microprocessor μP calculates, for example, the current speed and the current and the average petrol consumption of a motor vehicle. These values are to be displayed on the LCD display matrix LCD by means of a chain of drives 44100/1 . . . 44100/n.

The drives 44100/1 . . . 44100/n each have an identical structure, compared with one another, inter alia one shift register each, the input and output of which are led out to pins of these drives 44100. These shift registers of n drives 44100/1 . . . 44100/n are each connected in series to one another, the corresponding pins which are connected to the inputs and outputs of these shift registers being connected to one another. If the large number of bits of the column signals S which relate to the text and are successively input by the module 44780 pass through these shift registers, finally all the shift registers of the drives 44100/1 . . . 44100/n are each loaded with those column signals S which the drives 44100/1 . . . 44100/n are intended to pass on via their drive units to the display matrix LCD.

The microprocessor μP controls the display and, for this purpose, supplies short codes to an intermediately connected special module 44780, which codes only correspond to the meaning of the characters to be displayed to a greater or lesser extent. This special module can, for example, be the integrated module HD44780 manufactured by Hitachi which contains inter alia a character generator which itself generates from the short codes drive signals which are more concretely detailed and are intended to be supplied to the lines and columns of the display matrix LCD.

The character generator of this known module HD44780 contains inter alia an ROM. It can store the required column signals of characters and character combinations. For the display of a relatively long text on the display matrix, the microprocessor μP must supply here a separate 8-bit code more or less per character; however this 8-bit code supplied by the microprocessor μP is in each case still very short compared with the length of the complete bit pattern formed by the column signals of an individual character.

If the characters to be displayed contain, for example, in each case 40 pixels in 8 lines and 5 columns, 8×5 column signals S are required per character because in each case 5 column signals S are to be provided simultaneously per activated line. Therefore, the ROM of the character generator must store 40 line signals per 8×5 characters, which line signals are to be supplied to the drives 44100/1 . . . 44100/n in 8 series of 5 bits each.

An 8-bit code of the microprocessor μP can therefore successively call up out of the ROM of the character generator of the module HD44780 in each case 8 series of 5 column signals S which are fed by the module HD44780 (serially) into the input of the shift register of the first IC of the chain 44100/1 . . . 44100/n (it is indicated in FIG. 1 that the module HD44780 can additionally supply itself up to 40 columns Sz of the display matrix from its character generator, but is no longer taken into account here). The total number of column signals S which are to be generated by the module 44780 in order to display once (!) a relatively long text composed of, for example, 40 characters made up of in each case 8 lines and 5 columns by means of the drives 44100/1 . . . 44100/n is therefore no less than 8 series of 40×5 bits, that is to say considerably more bits (namely 1600 bits) than the total number of bits in those, in this case, approximately 40 8-bit codes which have to be supplied by the microprocessor μP to the module 44780 in order to control this display (200 bits).

This module 44780 therefore supplies for a single (!) display of this text 8 bits for the line signals Z which it feeds directly to the lines of the display matrix LCD together for all the characters to be displayed. In addition, for this purpose, it supplies the large number, namely 1600, of special column signals S, also generated by its character generator, in serial form to the input of the first of the n different drives 44100/1 . . . 44100/n which themselves pass on these column signals S by means of drivers, as a result with corresponding levels, to the columns of the display matrix LCD.

However, if the display matrix LCD is an LCD display, it is known that the 8 line signals Z and those 1600 column signals S are to be supplied to the display matrix LCD quickly repeated cyclically and continuously—instead of once—in order to obtain a display with a visually stationary appearance. Correspondingly, in this state of the art the module 44780 for this display must deliver its 8 character signals Z very frequently per second, and above all must deliver with the same frequency its respective 1600 column signals S. The maximum length of the drives 44100/1 . . . 44100/n is thus upwardly limited because the pulse repetition rate at which the column signals S have to be entered continuously into the relevant input of the first drive 44100/1 for a display cannot be increased to any desired extent. The length of the text which can be displayed with an adequately still presentation pattern is therefore severely limited in this state of the art. Moreover, the microprocessor μP and the module 44780 are then also highly loaded because both emit and have to process a large number of bits per second in order to maintain the still presentation pattern.

Each of these known drives 44100/1 . . . 44100/n is therefore an IC which serves as timed drive of a display matrix LCD, it also being the intention that this display matrix LCD will be able to display a long, multi-place text composed of letters, figures and/or other characters. The display matrix LCD contains columns and lines and thus at least two dimensions, and in fact it contains many more columns than lines in order also to be able to display the long, frequently only single-line text. The ICs 44100 of identical construction in each case therefore form a chain and supply column signals S for controlling the columns of the display matrix LCD, specifically each IC being intended to control in each case only some of those columns. Every IC 44100 contains a shift register into which bits are shifted which themselves—even in this state of the art—correspond to the text to be displayed on the display matrix, or at least to a section of this text. The input and the output of the shift register is connected directly—or at most via an isolating switch and/or driver stages which do not change the bit pattern—to pins of the IC in order, when required, to be able to shift the bits, under the control of the clock, successively through the chain—namely firstly through the shift register of the first IC of the chain, then through the shift register of the second IC of the chain and then, if present, through the shift registers of the further ICs.

The IC can be controlled during operation by a control processor μP which calculates for example driving speeds and/or other values to be displayed, this control processor μP supplying—in this state of the art only indirectly, for example via the intermediately connected module HD44780—the bits with which the shift registers of the chain are loaded.

There are further known drives for display matrices—even those which are used for driving the columns when the texts to be displayed are often very long and thus the number of columns to be driven is quite considerably greater than the number of column signal outputs of the relevant display modules. Thus, there is for example the module μPD7228 which is supplied by NEC. This IC has a character generator which in the IC converts short codes which are supplied by a microprocessor into the concrete column signals of the relevant columns. However, in this IC each individual drive is to be supplied in each case by the microprocessor via separate lines with the short codes relating to this IC, because these ICs do not have any shift register which has to be switched and operated as in the drive HD4100. There is no provision in the drive μPD7228 for these codes to be passed on, or for the ultimate column signals S to be passed on from IC to IC, although said module serves for controlling in each case only some of the columns. Therefore, if a very long text is to be displayed by means of this IC μPD7228, in fact a multiplicity of such ICs is used of which, however, each controls only some of the columns of the display matrix. Therefore, the microprocessor itself has to successively supply the different ICs with the relevant codes via separate control lines in each case.

In the publication E.D.N. (Electrical Design News) 30 (8 Aug. 1985) No. 18, Newton, Mass./USA, pages 83 to 88, drives SED1503 are also described which do not have a shift register which would permit such drives to be connected in chains by directly connecting the shift registers of these drives in series. A plurality of such drives SED1503 are connected in series and together supply control signals to an LCD display. Each of these drives SED1503 is supplied directly by a microprocessor μC with the corresponding codes. Due to the lack of correspondingly connected internal shift registers of these drives, it is actually not sufficient here for the microprocessor μC only to supply the first drive SED1503 of this series of drives with input signals because in fact the other drives of this series cannot be supplied directly by the output of a preceding drive of this series. Therefore, a chain connection is not possible with these drives SED1503.

However, lengthening a chain of such drives with the low expenditure in terms of wiring between the microprocessor and the drives as aimed at with the invention is then also not possible.

If the display matrix is to be subsequently lengthened—by lengthening the IC chain by means of further drives—for example by the number of column signal outputs of two ICs, for the aforesaid reasons the chain can be lengthened without many problems up to 80 characters of 5 columns only in the first example, namely in the case of the drive HD44100. However, in the case of the module μPD7228 and also in the case of the module SED1503 additional wiring measures must be taken to ensure that each of these drives is supplied with all the necessary data via separate lines.

In the case of drives of the type of the HD44100 module which can be switched in series, because of the omission of corresponding additional data lines or drive lines and the instructions connected therewith, the expenditure is in any case in comparison particularly low—especially if a very long display matrix is to be used. The intermediately connected module, for example HD44780, only has to supply its output signals, namely the column signals S, to the input of the shift register of the first IC of the chain.

As already explained, the invention is also based on an IC drive which, like the HD44100 module, can be connected together to form a chain in such a way that only the first IC of this chain has to be supplied directly with the bits corresponding to the text.

However, on the other hand, the invention still performs the following additional tasks:

The expenditure in terms of drive and in terms of time to supply the relevant shift register of the first IC of the chain with the data bits corresponding to the text is to be further reduced, in that the relevant first IC is fed from the outside

- no longer even with the enormous number of data bits which correspond to the concrete column signals—or which then even constitute continuously cyclically repeated column signals,
- but rather instead with only those relatively short codes, as data bits, which themselves only correspond to the meaning of individual characters or of individual character combinations to a greater or lesser extent.

Therefore, even in the case of an LCD display which is to be supplied with column signals in a rapidly repeating cycle, a microprocessor will have to supply to the input of the first drive (IC1) its bytes or data bits—excluding clock signals—only a single time per text to be displayed, instead of continuously repeatedly in frequent cycles per second.

The intermediate connection of a further module, cf. the module HD44780, which has a separate character generator for generating the column signals to be fed into the ICs, will become unnecessary.

Instead of reducing the expenditure in terms of drive and in terms of time it will be possible for virtually any desired number of ICs according to the invention to be arranged in a chain of thus virtually any desired length in that their relevant shift registers can easily be connected in series in such a way that the relevant data which are entered into the shift register of the first IC are shifted through the shift registers of all the ICs of the chain at least usually without changing their bit pattern.

In addition, the microprocessor is to be further relieved in that only the relevant ROM of a text memory of the first IC of the chain is then to be supplied by the microprocessor with particularly short codes which can be delivered particularly quickly (for example only with a short code of for example 8 bits which marks a long standard text, and possibly also with an associated numerical value code also of for example 8 bits), after which the output of the relevant ROM does, for its part, in fact emit relatively long codes, but ones which compared with the number of column signals are still always extremely short and which only correspond symbolically to a greater or lesser extent to an individual character or short character groups, these codes emitted by the relevant ROM of the first IC of the chain being shifted via the shift registers, connected in series, of the ICs, subsequently locally converted in the character generators of the individual ICs and emitted as concrete column signals to the display matrix.

This very complex task, which is per se new, is achieved by means of an IC apparatus for providing a timed drive of a display matrix comprising the display matrix being for displaying a multi-place text composed of letters, figures and/or other characters, the display matrix having very many more columns than lines in order to display an at least 1-line text, a plurality of identically structured ICs that form a chain of such ICs, that supply column signals for controlling the columns of the display matrix, specifically each IC controlling only some of the columns, each IC having a shift register into which bits are shifted which correspond to text to be displayed on the display matrix, or at least to a section of this text, an input and an output of the shift register being connected directly, or at most via an isolating switch and/or driver stages, to input and output pins of the IC in order, when required, to be able to shift the bits, under the control of a clock successively through the chain, namely through the shift register of a first IC of the chain, then through the shift register of a second IC of the chain and then, if present, through the shift registers of further ICs, and being controllable during operation by a control processor, which calculates driving speeds and/or other values to be displayed, each IC having a character generator connected downstream of the shift register, the character generator having a separate memory unit, and during operation, the character generator converting into output signals at least some of the bits, which correspond to only a short code for the contents of relevant characters, by means of the memory unit which is addressed by these bits, said output signals corresponding to IC output signals, and during operation, these IC output signals being first fed as column signals to the column inputs of the display matrix which are respectively assigned to this IC, each IC containing a read-only memory, which stores the bits which are required for the different displays and which are to be loaded into the shift registers of further IC/ICs and which transmits the relevant bits to the shift register of this IC when a relevant address or start address is called up, during operation only the read-only memory of the first IC of the chain, but not the read-only memory of the next, further IC/ICs of the chain, transmitting to the separate shift register of this first IC bits to the shift register of the next, further IC, and during operation the shift register or registers of the further IC/ICs of the chain being loaded by the shift register of the respective preceding IC of the chain.

Therefore, in the invention the enormous number of bits which correspond to the column signals S are no longer entered into the input of the first shift register of the chain of ICs but rather only the bits of short codes which in terms of contents approximately correspond to the meaning of the characters to be displayed. The combinations of column signals associated with the character are only generated according to the invention in the relevant ICs—in each case by means of the character generator mounted there in each case.

In a special further development of the invention, the microprocessor is relieved still considerably further, even if it is to display a very long standard text. In this further development, the codes which are supplied by the microprocessor to the relevant first IC of the chain can often only be formed by a short address.

In the invention, the length of the chain can be lengthened virtually to any desired degree, that is to say the number of ICs which can be connected in series can be increased to virtually any desired degree. Thus, even very long texts can be displayed by the invention without difficulty even if only relatively few bits are fed as a short code by the microprocessor only to the first of these ICs, and in fact to the input of its shift register. In this case, in the invention this microprocessor can generally supply its data bits directly to the relevant data input of the first IC of the chain without a further module which contains a separate character generator having to be intermediately connected—cf. the module 44780 in FIG. 1. Because according to the invention only relatively short codes have to be stored in the shift registers, it will also be possible to load the shift register of the last IC of this chain in each case comparatively quickly with its codes so that by virtue of the invention the expenditure in terms of time for preparing the display of a new long text is also particularly short.

The text indicated by the ICs according to the invention is in fact generally only one line long in order to reduce the number of different characters which have to be stored in preprogrammed form in the character generator. If the text to be displayed is multi-lined, it is often recommended for the same reason on the one hand to arrange on top of one another a plurality of display matrices displaying on single lines, in order to offer the reader a multi-line text, but, on the other hand, to control each of these single-line display matrices by means of separate ICs according to the invention.

The IC according to the invention does not show all its advantages until a plurality of such ICs are to be connected together to form a chain. However, the IC according to the invention can also be used when only a single IC according to the invention is used to display a text which is then always relatively short.

The measures disclosed below permit additional advantages to be obtained.

The first IC of the chain can also control lines of the display matrix, specifically jointly for all the ICs of the chain by also feeding line signals to the display matrix. This permits a separate module for controlling the lines of the display matrix to be dispensed with.

For each IC, a latch register which can buffer the contents of the shift register is connected downstream between the shift register and the character generator. This permits unsteady flickering of the displays during the preparation of a text to be newly displayed to be avoided.

On each IC, the column signals are fed to relevant IC pins via an output register connected downstream of the character generator. This permits a parallel-to-serial conversion of the bits supplied by the character generator.

The output register is formed by series connection of an output shift register and an output latch register. This permits a particularly operationally reliable, sturdy construction of the output register to be used, in which case, moreover, the corresponding output latch register itself additionally reduces the flickering of the text considerably during a change of the text to be displayed.

When the present invention is a drive for a liquid crystal display matrix, the output register and/or associated output driver stages transmit column signals consisting of more than two voltage levels, as well as, a line output register and/or associated driver stages. This permits the invention to be used for controlling display matrices if the column signals and/or line signals are always no longer to consist in a purely binary manner of just two levels but also at least some of them are to have other levels at certain times, as is often customary for example for an LCD display as a display matrix.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, and in which:

FIG. 1 shows and LCD display matrix controlled by ICs according to the prior art;

FIG. 2 shows by way of example an LCD display matrix which is controlled by a total of n ICs according to the invention, in which case it has been assumed that the first IC IC1 not only supplies column signals S but also line signals Z to the display matrix LCD;

FIG. 6 shows details of an IC example according to the invention in order to illustrate the cooperation between the text memory and the shift register; and FIG. 7 shows the connection in series of the shift registers of n=m+1 ICs.

DESCRIPTION OF THE PREFERRED EMBODIMENT

A comparison of FIGS. 1 and 2 shows that in the invention the ICs IC1 . . . ICn also form a chain by their shift registers being connected in series so that the short codes supplied by the microprocessor μP are supplied in each case to the signal input SIN of the shift register of the first IC IC1, and via the signal output SOUT of this shift register also to the signal input SIN of the following ICs . . . ICn. On the other hand, in the state of the art, cf. FIG. 1, in each case the corresponding signal inputs of the shift registers of the drives 44100/1 . . . 44100/n were not respectively supplied with the codes but rather, with a high expenditure in terms of time, with more detailed column signals as a very comprehensive bit pattern. The term "detailed" means that the various column signals either represent codes that only represent mini-details of the characters to be displayed or that these column signals relate to complete decoded signals for displaying an individual pixel, for example, "detailed" means that the different column signals are codes concerning mini-details of the display characters, or that these column signals are entirely decoded signals wherein each of them control a pixel display). The ICs IC1 . . . ICn according to the invention therefore contain in each case separate character generators which themselves first convert in the ICs the codes buffered in the shift registers into the large number of column signals S.

Figure 3:
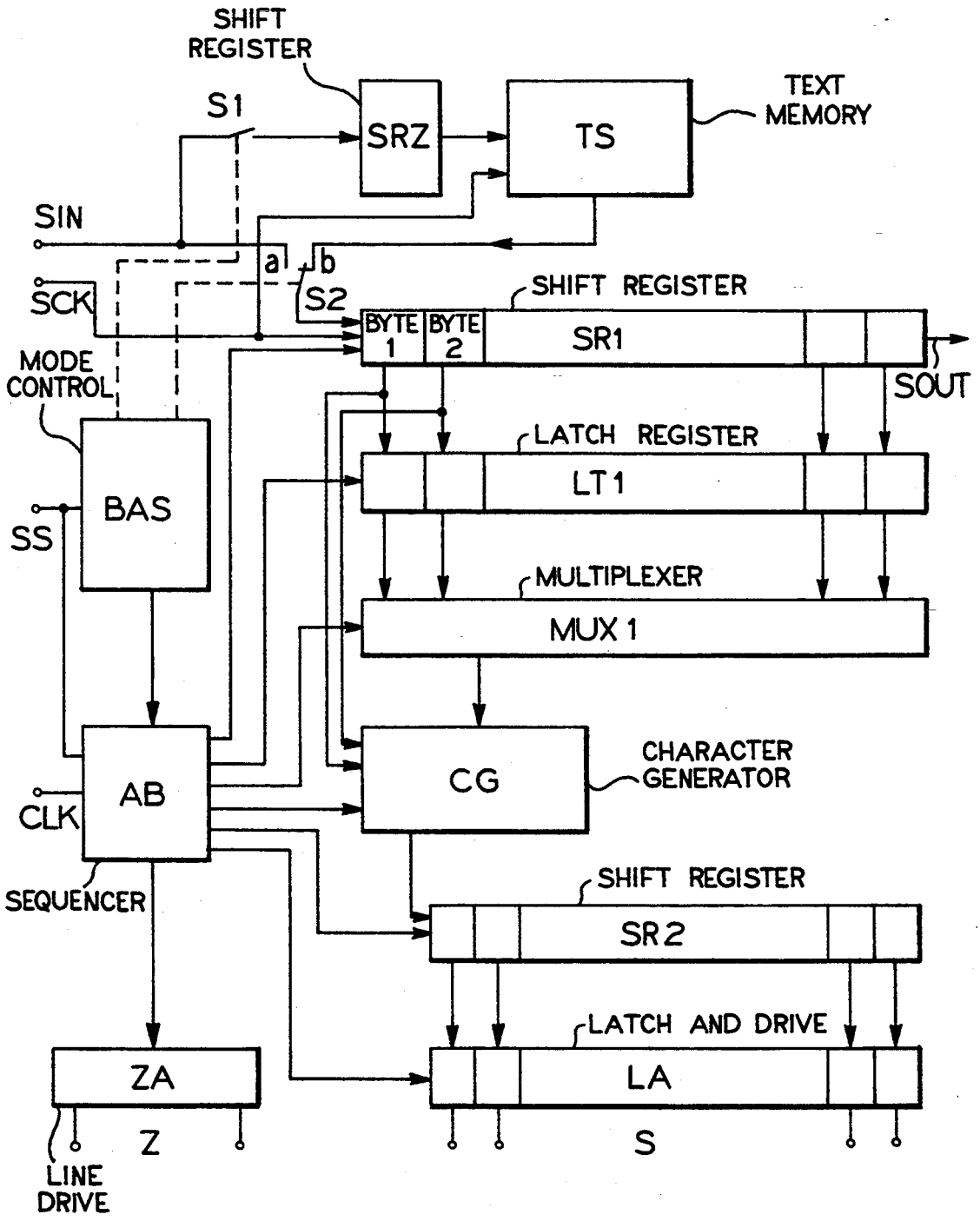
FIG. 3 shows an example of circuits which are mounted on an IC according to the invention.

The microprocessor μP can per se directly load the relevant codes—which correspond for example in each case to a single character of the text to be displayed—into the shift register of the first IC of the chain. However, FIGS. 3 and 4 show a further development in which the microprocessor μP, when required, can additionally be operated in such a way that—with the exception of possible clock pulses SCK which are also supplied by the microprocessor μP—it only has to supply an extremely small number of data bits to the ROM of a text memory TS which is additionally mounted in the IC and, itself, first loads the shift registers of the chain with—still relatively short—codes which correspond in each case for example to individual characters or short character combinations of text. However, initially operation of the IC according to the invention is described in which the text memory TS is not used:

Therefore FIG. 3 shows an example of the structure of the circuits in an IC according to the invention. The short codes—for example supplied by the microprocessor μP—can be loaded directly into the input of the shift register SR1 via the data input SIN and directly via the switch S2 (in its position a), which shift register itself supplies short codes, supplied by this microprocessor μP, to the data input SIN of the next IC of the chain via the data output SOUT. FIG. 3 shows in diagrammatic form that the codes, represented by byte 1, byte 2 . . . , successively pass through the memory cells of the shift register SR1, in which case each byte requires for example eight successive memory cells of the shift register SR1. In this case—if therefore no text memory TS is used—all the bits which are loaded into the shift registers SR1 are directly supplied by the microprocessor μP.

The position of the switches S1 and S2 is determined for example by the operating mode control BAS. The operating mode control BAS itself is externally controlled here, together with the sequencer AB, symbolically by a signal SS; a concrete solution for its control is shown by FIG. 4—that is to say the switch S2 is moved into the position a, in this way the data bits supplied by the microprocessor μP are shifted directly into and through the shift register SR1 from the data input SIN by means of the clock signal SCK. In each case at the same time the data of the shift register SR1 which have already been shifted through and can be supplied there to the data input SIN of a subsequent IC appear at the data output SOUT.

At the latest as soon as the shift registers SR1 of all the ICs are loaded with the desired data bits, these data bits can be transferred into the latch registers LT1 of each IC, again for example by means of a corresponding signal of the operating mode control BAS. For example the sequencer AB can ensure that in each case 1 byte=8 bits from the latch register LT1 are applied via the multiplexer MUX1 to the inputs, in this case 8, of the character generator CG, the multiplexer MUX1 applying, for example cyclically, all the bytes of the latch register LT1 in succession to the input of the character generator CG. The operating state after loading all m+1 shift registers with 14 bytes in each case is indicated diagrammatically in FIG. 7, the first IC being designated here as "master" and the m following ICs being designated as "slaves".

Figure 4A:
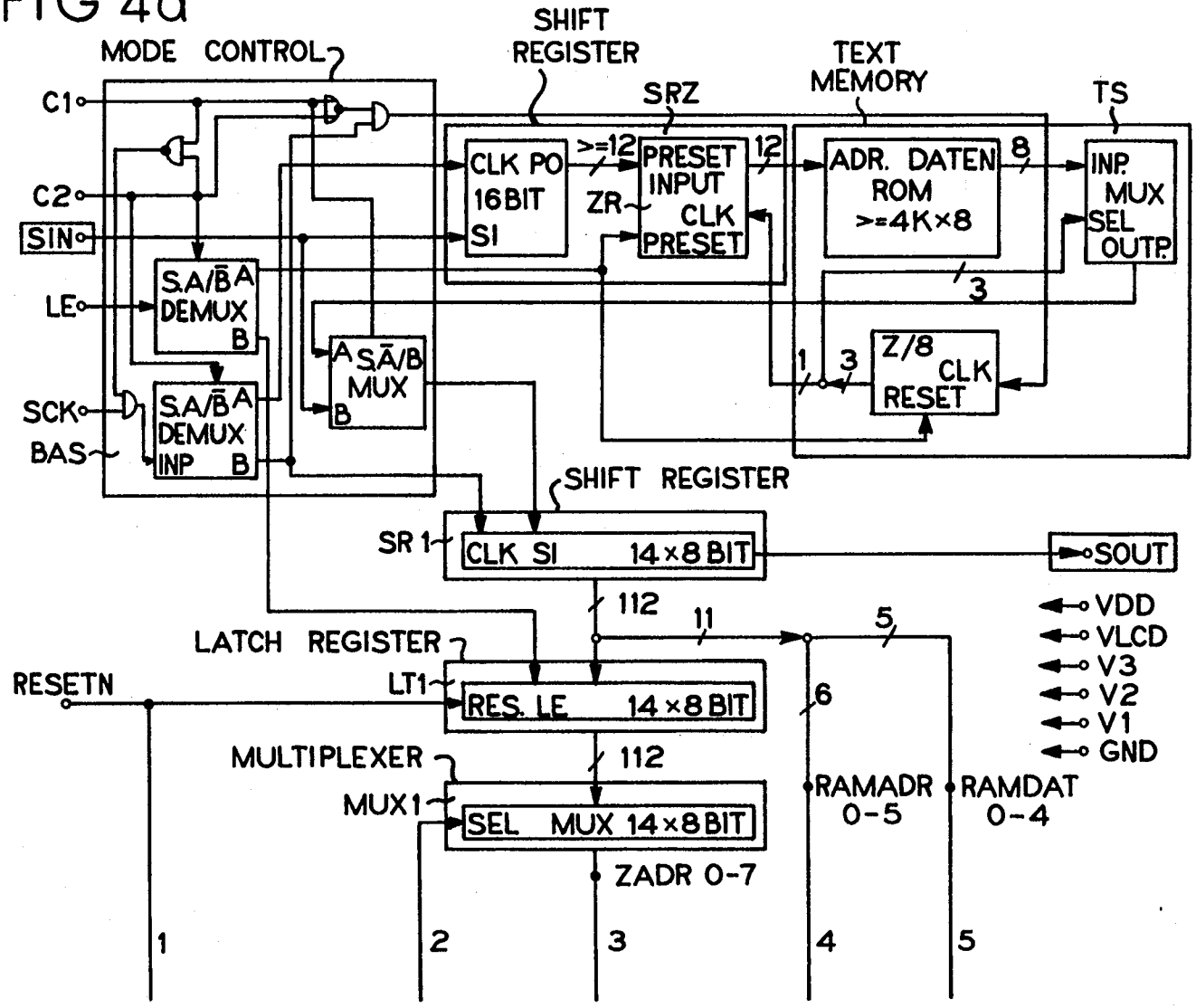
FIGS. 4*a* and 4*b* shows in a much more detailed manner the example shown in FIG.

A particular advantage of the invention results from the fact that—with the exception of possible clock pulses SCK which are also to be supplied by this microprocessor μP, cf. FIGS. 3 and 4a—the microprocessor μP only has to feed its codes a single time into the relevant input of the first IC IC1 or master of the chain even if the character generators CG of all m+1 ICs have to supply the column signals S to a display matrix in repeated frequent cycles per second, in case the said matrix is for example an LCD display!

The character generator CG is for example a ROM which is addressed by the applied bytes. It then successively generates the output signals which correspond to the large number of concrete column signals S and here in the present example are fed into the further shift register SR2 connected downstream. The character generator CG therefore serves to convert codes or input data byte 1, byte 2 . . . , which are loaded into the shift registers SR1, into the column signals S required for the display matrix LCD in order to generate the desired displays at the appropriate character positions and line positions.

The displays and thus the character generator output signals can also be changed from time to time during the operation of the IC by changing the codes byte 1, byte 2 . . . , as a result of which the displayed texts are changed from time to time.

The expenditure of the microprocessor μP in terms of drive, cf. FIG. 2, is particularly low in the invention—even if the text memory TS is not yet used—because the microprocessor μP only feeds the first IC IC1 of the chain with data, the bits of these data not representing the detailed column signals S but rather relative short codes which themselves correspond only to a greater or lesser extent to the meaning of individual characters to be displayed or of entire character groups or character combinations to be displayed. The character generators CG of the individual ICs generate in each case from the codes which are loaded into the shift registers SL1 the column signals S which are to be emitted by the relevant IC. In this way, the expenditure in terms of time for transmitting the bits from the output of the microprocessor μP as far as the end of the last shift register of the IC chain, cf. ICn in FIG. 2, is particularly small, precisely because only relatively short codes have to be shifted through the shift registers SR1 of the ICs IC1 . . . ICn instead of that enormous number of detailed column signals S.

Because in the embodiment shown in FIG. 3 there is a latch register LT1 inserted between the shift register SR1 on the one hand and the character generator CG or the signal outputs of the column signals S of the IC on the other, an unsteady flickering of the display is avoided during the preparation of a text which is to be newly displayed, and, in fact, because when (!) loading the shift registers SR1 the character generators CG of the ICs are not driven immediately but rather preferably not until (!) the loading of all the shift registers SR1 of the ICs has been terminated.

Moreover, in the example shown with a special external control signal supplied to the IC, for example by means of the byte 2 indicated in FIG. 3, in addition a special RAM can be addressed in the character generator CG before the display of a (new) text, in order to overwrite this RAM, for example with the byte 1, which will be easier to identify with reference to the circuit diagram shown in FIG. 4 and explained in greater detail later. This further development of the invention permits quite special column signals S to be generated when required from the special data (here therefore for example from byte 1) stored in the RAM, which column signals S are not preprogrammed in the ROM of the character generator CG but rather are required for example for displaying especially rarely used characters—for example for rarely used Greek or Cyrillic characters—which cannot be generated by means of the ROM of the character generator CG. The sequencer AB can also assume the clocking for this.

Moreover, the first IC IC1 of the chain can also control the small number of line signals Z required for the display matrix and, in fact, do this together for all the ICs IC1 . . . ICn of the chain, possibly also by means of its sequencer AB, as a result of which a separate module for controlling the lines of the display matrix LCD can be dispensed with.

In the example shown in FIG. 3, in each case an output register SR2 and LA is additionally connected—in particular to form a serial-to-parallel conversion of the bits—downstream between the character generator CG and the IC pins which transmit the column signals S to the display matrix LCD.

SR2 is also a shift register in respect of its structure and operation. As soon as the shift register SR2 is loaded via the character generator CG with corresponding column signal data, these data are buffered in the further "latch and driver output stages" LA block connected downstream and are output as column signals S—generally in quickly repeated cycles—at the column outputs of the IC. Of course, it is known, as already mentioned, that an LCD display matrix also requires non-binary column signals S which therefore have further voltage levels—the output register, cf. LA, and/or associated output driver stages must then emit column signals S which contain more than two voltage levels.

The output register can therefore be formed for example by a series arrangement of an output shift register SR2 and an output latch register LA. As a result, a particularly operationally reliable, sturdy structure of the output register is obtained, in which case, moreover, the corresponding output latch register itself additionally considerably reduces the flickering of the text when switching over from one line to the next line.

The example shown in FIG. 3 of the IC according to the invention additionally contains the text memory TS, already mentioned many times, having a separate ROM which in each case stores the bits byte 1, byte 2 . . . which are required for the various displays and are to be stored in the shift registers SR1, and which text memory transmits the relevant bits byte 1, byte 2 . . . to the shift register SR1 of this IC when a corresponding start address is called up.

Figure 5:
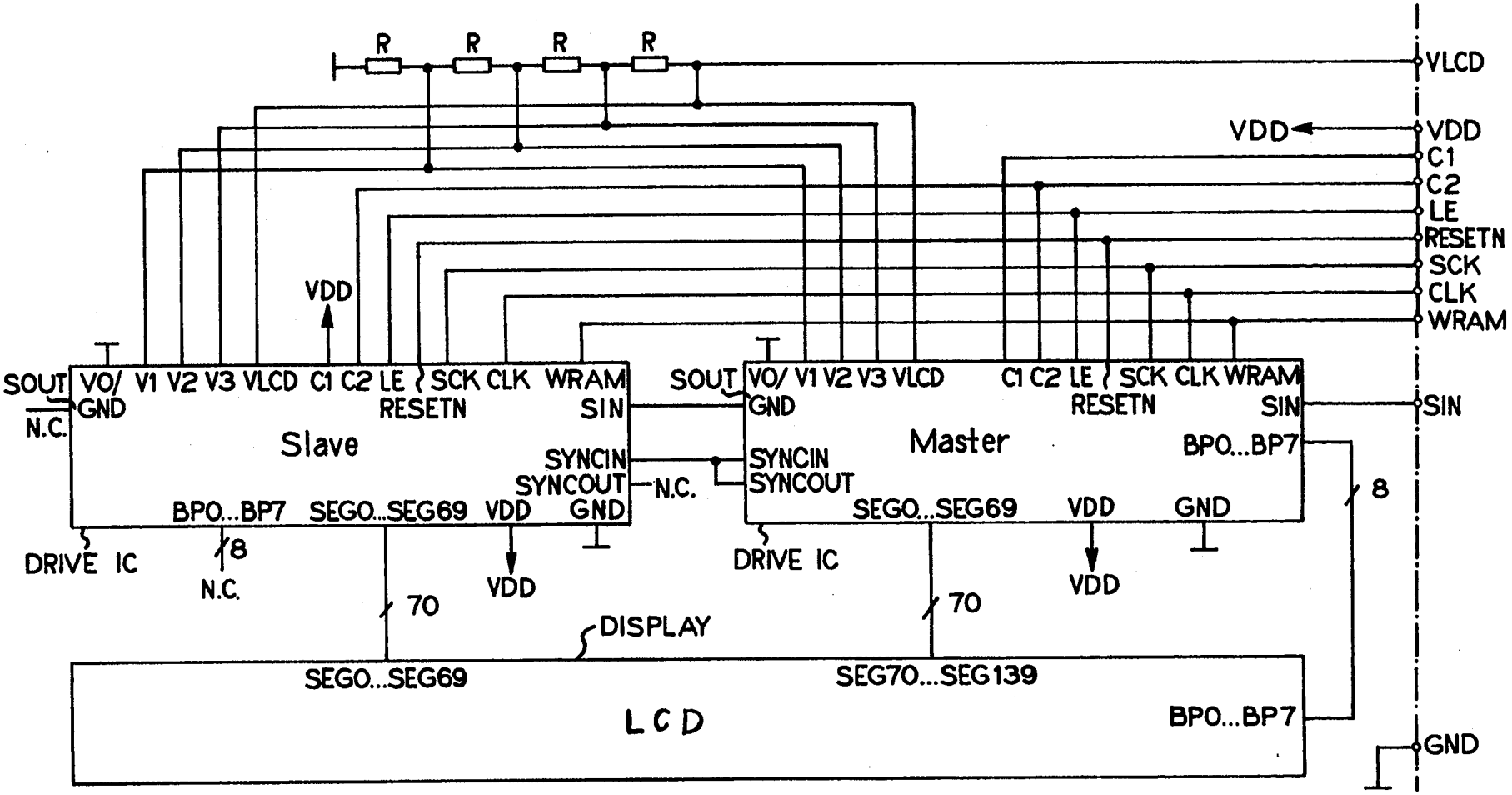
FIG. 5 shows an example of the wiring of the IC shown in FIGS. 4*a* and 4*b* if thus a circuit according to FIG. 2 is to be built up with n=2 ICs; this FIGURE serves principally for illustrating the current supply and signal supply of a chain of two IC examples according to the invention, namely of a master corresponding to the first IC and of a slave corresponding to the second IC, the microprocessor supplying the signals not being shown;—then if still further ICs are to be inserted between the master and the slave, these further ICs are supplied in principle in the same way as the slave.

However, in this further development of the invention only the ROM of the text memory TS of the first IC of the chain, referred to in FIGS. 5 and 7 as "master" transmits during operation the relevant bits, cf. byte 1, byte 2 . . . , to the separate shift register SR1 of this first IC. On the other hand, during operation the ROM of the text memory TS of the next, further ICs of the chain, referred to in FIGS. 5 and 7 as "slave", does not transmit any bits to the separate shift registers SR1 of the relevant next ICs: for this purpose, in fact, the switch S1 is activated only in the first IC of the chain, cf. IC1, and the switch S2 is only activated in the first IC of the chain in the position b—on the other hand, in the other ICs of the chain, that is to say in the slaves ICI. . . ICn the switch S1 is in its deactivated state in each case and the switch S2 is in its position a in each case. In this way, the shift register or registers SR1 of the next further IC or ICs of the chain, that is to say in the slaves, are only loaded during operation by the shift register SR1 of the respective preceding IC of the chain—but not by the ROM of the separate text memory TS of these slaves. This operation of the ROM—which can be addressed here for example by means of a small separate address shift register ADRL/ADRH—of the text memory TS is illustrated diagrammatically in FIG. 6.

Expressed in numbers this means that the short code supplied by microprocessor μP can comprise for example bytes of 8 bits, it being possible for the first byte to correspond to a character but also to a character combination, of virtually any desired length, of perhaps even 100 hundred characters, for which purpose the ROM of the text memory TS only has to be of sufficiently large dimensions—cf. the size of the ROM in the text memory TS in FIGS. 4*a* and 6. In this case, the master module IC1 according to the invention has to be supplied—differently from the state of the art, cf. the module 44100/1 in FIG. 1—with input data at the input SIN only once per text to be displayed instead of in frequently repeated cycles per second, even if an LCD display is used as display matrix LCD. The short, for example 8-bit long code, then therefore corresponds for example to a single graphic character or also a word text—which in an extreme case may even be a very long standardized one. A second code supplied by the microprocessor μP, for example a second byte, can then also correspond to a numerical value which is to be displayed additionally.

A text memory ROM which is connected and operated in this way permits the microprocessor μP to be further relieved. In this case, the microprocessor μP in fact supplies—again with the exception of clock signals SCK—only quite short codes to the ROM of the text memory TS of the master, that is to say the first IC of the chain, but—at least generally—no longer directly to the shift register SR1 of the master IC1. The codes supplied by the microprocessor μP to the ROM of the text memory TS of the master IC1 can then therefore mark for example even a quite long standard text, and if required can also even contain an associated numerical value code, cf. for example the text "YOU HAVE EXCEEDED THE MAXIMUM ADMISSIBLE SPEED BY . . . km/h!".

The text memory TS (phase generator) is operated for example as follows:

As soon as the switch S1 is closed, the signals of the data input SIN pass into a special shift register SRZ connected upstream of the text memory TS and, in the said shift memory, set a counter to a start address. This start address serves for addressing the ROM of the text memory TS. In the examples shown, the switch S2 can subsequently be switched into the position b for example by means of the operating mode control BAS.

If a bit or byte with the clock SCK is now transmitted via the data input SIN, the data transmitted with it are initially ignored by the shift register SR1 because of the position b of the switch S2 and instead data byte 1, byte 2 . . . from the text memory TS, starting from the start address selected by the microprocessor μP, are shifted into the shift register SR1. After a first byte is read out of the text memory TS the counter in the special block of the shift register SRZ is incremented, as a result of which the next entry in the ROM of the text memory TS is addressed or prepared.

Subsequently, the ROM of the text memory supplies a subsequent byte to the shift register SR2, and after this the further bytes in a corresponding manner. These bytes supplied to the shift register SR1 can ultimately be shifted through the entire shift register SR1 and in the next IC of the chain can directly load, by means of the switch S2 of said IC in position a, the shift register SR1 there. These bytes byte 1 , byte 2 . . . also correspond in this further development of the invention to the meaning of individual characters or short character combinations to be displayed only to a greater or lesser extent, which characters or character combinations themselves are only converted into the more detailed column signals S by means of the character generators of the individual ICs.

Figure 4B:
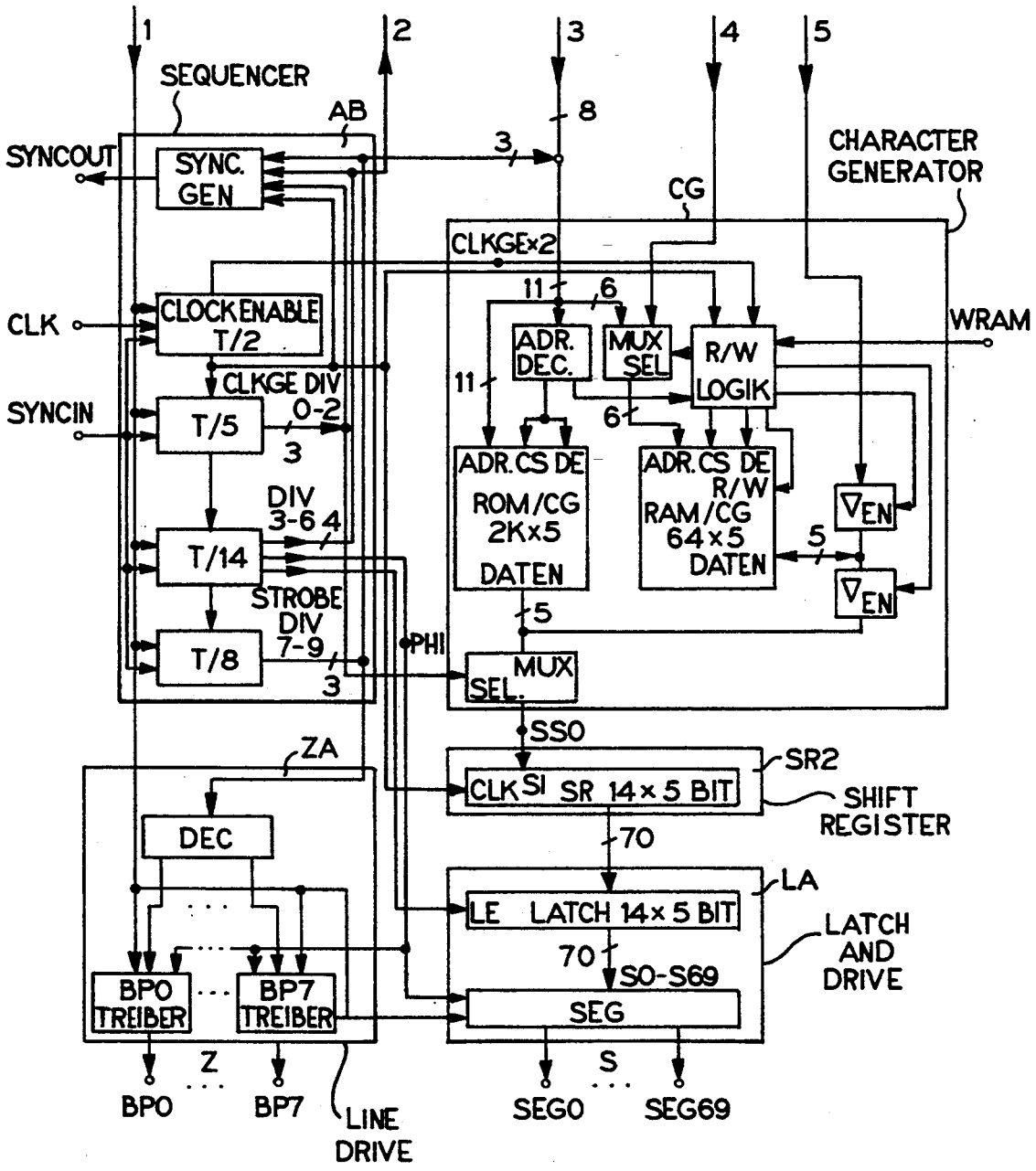

This example shown diagrammatically in FIG. 3 can be built up and operated for example in accordance with the much more detailed circuit depicted in FIGS. 4*a* and 4*b*.

The examples shown in FIG. 4*a* and 4*b* of an IC according to the invention has 70 segment lines SEG0 . . . SEG69 for 14×5 simultaneously transmittable column signals S. Furthermore, it has 8 backplane lines BP0 . . . BP7 for 8 line signals Z, the multiplex rate here being 1:8—in accordance with the requirement of the special LCD display used here—and the line signals Z having 4 voltage levels V0, V1, V3, VLCD, and the column signals having 3 voltage levels V0, V2, VLCD.

In addition, this example has the terminals C1 and C2 which permit the operating mode of the IC to be selected. If a plurality of ICs are to be connected to form a chain, C1 and C2 of the master are connected to the controlling processor, cf. also FIG. 5. On the other hand, in all the slaves C1 is constantly applied to high level and all the C2 terminals are directly connected to the C2 terminal of the master, cf. FIG. 5. In this way, the following possible functions are produced:

1) C1=C2=0: the shift register SR1 is loaded out of the text memory TS.
2) C1=0; C2=1: the data are loaded by the input SIN into the shift register SRZ according to FIGS. 3 and 4 (or ADRL/ADRH according to FIG. 6).
3) C1=1; C2=0: the data are loaded by the input SIN directly into the shift register SR1. However, if the shift register SR1 of the relevant IC is already loaded with all the desired data, an external pulse which can be fed via the terminal LE transfers these data into the latch register LT1 which itself is read, under the control of the internal sequencer, in order to use the data as addresses for addressing the character generator CG.
4) C1=C2=1: the input SIN is blocked.

Furthermore, the example shown in FIGS. 4*a*, 4*b* and 5 has a latch-enable input LE. Depending on the level of the C2 terminal, the values of the shift register contained in SRZ are transferred into the address counter in block SRZ or the values of the shift register SR1 are transferred into the latch register LT1. At the same time, pulse-edge control, for example transferral with rising edges, can be provided.

The clock already mentioned can be input via the input SCK.

SIN is the data input via which data bits can be transferred serially from the microprocessor in synchronism with the clock pulses SCK, the highest order bit being preferably transmitted first in the example shown.

SOUT is the output of the shift register SR1 of the relevant IC, it being possible for the input SIN of a subsequent IC of the chain to be connected to this output SOUT, cf. also FIGS. 5 and 7.

SYNCOUT is an output which serves for synchronization. In the master, cf. FIG. 5, the output SYNCOUT is connected to the terminal SYNCIN. On the other hand, in the slave, the terminal SYNCIN is connected to the output SYNCOUT of the master.

SYNCIN is therefore an input which serves for synchronization with the master and in the active state is set to high. WRAM is an input which serves to control tile transferral of data bits out of the shift register SR1 into the RAM of the character generator CG. In the active state, the terminal WRAM is set to high, it being possible for this terminal to be level-triggerable.

CLK is a further clock input which can serve for controlling all the internal processes, in particular as a "pixel clock" in the example shown. The clock frequency is for example $14\times80=1120$ times the image regeneration frequency.

RESETN is a reset terminal which is low in the active state and serves for resetting internal registers.

VDD serves for the +5 V logic voltage supply.

VLCD serves for supplying positive voltages.

V3, V2, V1 are positive auxiliary voltages which are generated from VLCD by means of a voltage divider R shown in FIG. 5.

V0/GND is the ground terminal.

The aforesaid terminals are not only shown in FIGS. 4*a* and 4*b*, but also in FIG. 5 in order to be able to illustrate better existing differences and similarities between the current supply and signal supply in a comparison between the master on the one hand and the slaves on the other when using ICs according to the invention in accordance with FIG. 4*a* and 4*b*.

The sequencer AB consists here for example of a plurality of divider stages. The first divider stage T/2 divides the clock in two and generates a 4-phase clock which is necessary for internal processes.

The second divider stage T/5 reduces the clock once more to 1/5 and serves for selecting a column in the $5\times8$ character matrix of the character generator CG. The third divider stage T/14 further reduces the clock to 1/14 and serves for selecting a character position within that section of the display matrix LCD whose columns are controlled by the relevant IC. The fourth divider stage T/8 reduces the clock once more to ⅛ and serves for selecting one of the 8 lines here. The stage "Sync. Gen." serves here for synchronizing a plurality of ICs according to the invention with one another.

Therefore, 4 operating modes can be selected via the inputs C1 and C2—and, specifically, by means of the operating mode control BAS and by means of logical elements or multiplexers which correspond to the switches S1 and S2 shown in FIG. 3, cf. so that also the functions of the inputs C1 and C2 already mentioned above:

1) Load the shift register SR1 from the text memory TS (corresponds to: switch S2 is in position b);
2) Load the shift register in SRZ with data from the data input SIN (corresponds to: switch S1 is activated);
3) Load the shift register SR1 with data from the data input SIN (corresponds to: switch S2 is in position a); and
4) Deselection of the IC.

The IC data input also comprises the input SIN for data bits and the input SCK for a clock; these inputs constitute a synchronous serial interface.

Therefore, control signals are applied from outside to the internal circuit blocks via the inputs C1 and C2.

The special shift register "16 bit" in the circuit block SRZ which corresponds to the address shift register ADRL/ADRH in FIG. 6, accepts the data from the data input SIN in operating mode 2) until an LIE pulse follows. The counter ZR connected downstream can be previously occupied with the word of the shift register "16 bit". The counter state serves here for addressing the ROM of the text memory TS.

The text memory TS contains a ROM of, here, 8 bits in width. A multiplexer MUX selects a bit from the 8 bits read out respectively from the ROM and the said bit is applied in operating mode 1) to the input of the shift register SR1. A counter Z/8 in the text memory TS addresses the multiplexer MUX and at the same time successively selects all the bits which are at the respective ROM address.

If all 8 bits are selected, the counter ZR in the block SRZ receives a pulse and addresses the next address in the ROM in order to be able to read the next 8 bits out of the ROM.

The shift register SR1 is 112 bits long here and is divided up into 14 groups of 8 bits each. In this way, 14 bytes, that is to say for example 14 characters, can be driven via the 70 column lines S or SEG0 . . . SEG69 of the display matrix LCD. The last bit of the shift register SR1 is also fed in each case to the output SOUT.

The latch register LT1 serves for storing the entire final contents of the shift register SR1.

The multiplexer MUX1 serves here for selecting an 8-bit group (corresponds to 1 byte) from the bytes, in this case 14, stored in the latch register LT1. The 8-bit initial value transmitted by the multiplexer MUX1, that is to say the selected byte, serves subsequently as an address for the memory in the character generator CG.

The character generator CG contains a memory which can be addressed by the multiplexer MUX1 and by the sequencer AB, and consists here of two parts, cf. ROM and RAM. Part of this memory is therefore a ROM and part a RAM. An address decoder ADR.DEC assumes the selection here between the RAM and the ROM.

Each memory input is 5 bits wide in the example shown;—this corresponds to the 5 columns, that is to say the number of columns, selected here, for each character which is to be displayed in a 5 column$\times$8 line matrix on the display matrix LCD.

Only the contents of the RAM of the character generator CG can therefore be easily changed from time to time: the column signals S for rarely required special symbols such as Greek or Cyrillic characters can be written into the RAM of the character generator CG, as already described, before the start of the text displays—for example in the special operating mode described above for loading this RAM. For this purpose, a pulse can be applied to the terminal WRAM in order to load the address of the RAM, which can be addressed for example with the byte 2 of the shift register SR1, with the value of the byte 1 of the shift register SR1. In this way, those special additional characters, that is to say special characters which have not been hitherto stored in the ROM of the character generator TG, can be defined. If the display matrix LCD is not supplied with column signals S solely by a single IC according to the invention, that is to say therefore solely by the master, but if instead a chain of ICs according to the invention is applied, the RAM in the character generator CG of each IC of the chain, that is to say both in the master and in the slave, should be written, at least in this case, with the desired additional data, in case the relevant special symbol is not only intended to be displayed on the text to be displayed at such points which are supplied with the relevant column signals S by a single IC of the chain.

A multiplexer MUX serving as parallel-to-serial converter at the output of the character generator CG selects, under the control of the corresponding driver signals of the sequencer AB, 1 bit in each case from the 5 bits which are provided by the ROM or RAM memory for the respective activated line of the relevant character. The 5 bits converted into serial form in this way therefore serve as input signal for the further shift register SR2. The coordination of the processes is assumed here by the read/write logic, R/W logic, of the character generator CG.

The further shift register SR2 is 70 bits long here, corresponding to those 14 5-column characters. In this shift register SR2, each bit corresponds to one pixel on in each case one of the lines of the display matrix LCD driven by the line outputs Z or BP0 . . . BP7.

The latch register LATCH in block LA serves as a memory for the contents of the shift register SR2 whereas the further shift register SR2 is already loaded with the column signal data for the next line of the display.

The segment driver SEG in block LA serves for generating the necessary digits, here requiring to a certain extent more than two voltage levels, of the output voltage characteristics such as are required for driving LCD display matrices, in particular with a multiplex rate of 1:8 in a manner known per se.

The line drive ZA generates here from the counter states of the last divider T/8 of the sequencer AB the necessary output voltage characteristics, also having to a certain extent more than 2 levels, for the lines of the display matrix LCD, such as are required in a manner known per se for driving an LCD display matrix with a multiplex rate of 1:8.

If only a single IC according to the invention, which is intended to transmit master column signals S to the display matrix, is present, that is to say if no slave is attached, then the IC according to the invention can be operated like the master in FIG. 5. On the other hand, if in addition one or more slaves are attached, the ROM of the text memory TS will switch off all these slaves in each case by means of a constant high level at C1, cf. FIG. 5. All the C2 terminals of the master and the slaves are directly connected to one another and driven together by the microprocessor. The SYNCIN inputs of the slaves are connected in each case directly to the SYNCOUT output of the master.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An integrated circuit display driver system for providing a timed drive of a display matrix, comprising:

the display matrix being for displaying a text composed of at least one of letters, figures and other characters, the display matrix having very many more columns than lines in order to display an at least 1-line text, a plurality of identically structured integrated circuits that form a chain, that supply column signals for controlling the columns of the display matrix, specifically each integrated circuit controlling a number of respective columns of all the columns of the display matrix, each integrated circuit having a shift register into which bits are shifted which correspond to at least a section of text to be displayed on the display matrix, an input and an output of the shift register being operatively connected to an input pin and an output pin, respectively, of the integrated circuit in order, when required, to be able to shift the bits, under the control of a clock, successively through the chain, namely through the shift register of a first integrated circuit of the chain, then through the shift register of a second integrated circuit of the chain and then, if present, through the shift registers of further integrated circuits, and being controllable during operation by a control processor that provides short codes indicative of the text to be displayed, each integrated circuit having a character generator connected downstream of the shift register, the character generator having a memory unit, and during operation, the character generator being addressed by at least some of the bits that are received from the shift register and the character generator generating output signals according to the at least some of the bits, the at least some of the bits thereby corresponding to said short codes, said output signals corresponding to integrated circuit output signals, and during operation, these integrated circuit output signals being fed as column signals to the column inputs of the display matrix which are respectively assigned to this integrated circuit, each integrated circuit also having a read-only memory operatively connected to the shift register of its respective integrated circuit, said read only memory storing the bits which are required for at least different characters and which are to be loaded into respective shift registers of further integrated circuits and which transmits the relevant bits to the shift register of this integrated circuit when a relevant address or start address is provided by the control processor, during operation only the read-only memory of the first integrated circuit of the chain, but not the read-only memory of the next, further integrated circuit of the chain, transmitting bits to the separate shift register of this first integrated circuit and to the shift register of the next, further integrated circuit, and during operation the respective shift registers of the further integrated circuits of the chain being loaded by a respective shift register of a respective preceding integrated circuit of the chain.

2. The integrated circuit display driver system apparatus as claimed in patent claim 1, wherein the first integrated circuit of the chain also is connected to and controls lines of the display matrix for all the integrated circuits of the chain by also feeding line signals to the display matrix.

3. The integrated circuit display driver system apparatus as claimed in patent claim 1, wherein for each integrated circuit, a latch register which can buffer the contents of the shift register is connected downstream between the shift register and the character generator.

4. The integrated circuit display driver system apparatus as claimed in patent claim 1, wherein on each integrated circuit, the column signals are fed to relevant integrated circuit pins via a column signal register connected downstream of the character generator.

5. The integrated circuit display driver system apparatus as claimed in patent claim 4, wherein the column signal register is formed by a series connection of a column shift register and an output latch register, said column shift register connected to said character generator and said output latch register connected to said relevant integrated circuit pins.

6. The integrated circuit display driver system apparatus as claimed in patent claim 4, wherein the integrated circuit apparatus is a drive for a liquid crystal display and at least one of the column signal register and associated output driver stages transmit column signals consisting of more than two voltage levels.

7. The integrated circuit display driver system apparatus as claimed in patent claim 2, wherein at least one of an output line register and associated driver stages transmit line signals consisting of more than two voltage levels.

8. The integrated circuit display driver system apparatus as claimed in patent claim 6, wherein at least one of an output line register and associated driver stages transmit line signals consisting of more than two voltage levels for controlling the liquid crystal display.

9. An integrated circuit display driver system for providing a timed drive of a display matrix, the display matrix displaying a text composed of at least one of letters, figures and other characters, the display matrix having more columns than lines in order to display at least 1-line text, a plurality of identically structured integrated circuits forming a chain that supply column signals for controlling the columns of the display matrix, specifically each integrated circuit controlling a number of respective columns of all the columns of the display matrix, said integrated circuit comprising:

a shift register into which bits are shifted which correspond to at least a section of text to be displayed on the display matrix, said shift register having an input and an output being operatively connected an input pin and an output pin, respectively, of the integrated circuit, wherein bits under the control of a clock, successively shifted through the chain, namely through a shift register of a first integrated circuit of the chain, then through a shift register of a second integrated circuit of the chain and then, if present, through shift registers of further integrated circuits, and being controllable during operation by a control processor that provides short codes indicative of the text to be displayed;

a character generator connected downstream of the shift register, the character generator having a memory unit, and during operation, the character generator being addressed by at least some of the bits, the at least some of the bits being received from the shift register, and the character generator generating output signals according to the at least some of the bits, the at least some of the bits thereby corresponding to said short codes, said output signals corresponding to integrated circuit output signals, and during operation, these integrated circuit output signals being first fed as column signals to the column inputs of the display matrix which are respectively assigned to this integrated circuit;

a read-only memory operatively connected to the shift register of its respective integrated circuit, said read-only memory storing the bits which are required for at least different characters and which are to be loaded into shift registers of further integrated circuits and which transmits the relevant bits, to the shift register of this integrated circuit when a relevant address or start address is provided by the control processor;

wherein during operation only the read-only memory of the first integrated circuit of the chain, that transmits to the shift register of this first integrated circuit, also transmits bits to a shift register of a next, further integrated circuit, and wherein during operation the shift registers of the further integrated circuits of the chain are loaded by a respective shift register of a respective preceding integrated circuit of the chain.

10. The integrated circuit display driver system apparatus as claimed in patent claim 9, wherein a latch register that can buffer the contents of the shift register is connected between the shift register and the character generator.

11. The integrated circuit display driver system apparatus as claimed in patent claim 9, wherein the column signals are fed to relevant integrated circuit pins via a column signal register connected downstream of the character generator.

12. The integrated circuit apparatus as claimed in patent claim 11, wherein the column signal register is formed by a series connection of a column shift register and an output latch register, said column shift register connected to said character generator and said output latch register connected to said relevant integrated circuit pins.

13. The integrated circuit display driver system apparatus as claimed in patent claim 11, wherein the integrated circuit is a drive for a liquid crystal display and wherein at least one of the column signal register and associated output driver stages transmit column signals having more than two voltage levels.

14. The integrated circuit display driver system as claimed in patent claim 13, wherein at least one of an output line register and associated driver stages transmit line signals having more than two voltage levels for controlling the liquid crystal display.

* * * * *